US007028834B2

(12) United States Patent
Karpel

(10) Patent No.: US 7,028,834 B2
(45) Date of Patent: Apr. 18, 2006

(54) HARD CASE FOR CARRYING SMALL ARTICLES

(75) Inventor: Isaac Karpel, Weston, FL (US)

(73) Assignee: Eye Level Corp, Weston, FL (US)

( * ) Notice: Subject to any disclaimer, the term of this patent is extended or adjusted under 35 U.S.C. 154(b) by 184 days.

(21) Appl. No.: 10/715,204

(22) Filed: Nov. 17, 2003

(65) Prior Publication Data

US 2005/0103648 A1 May 19, 2005

(51) Int. Cl.
*A45C 11/04* (2006.01)
*B65D 6/18* (2006.01)

(52) U.S. Cl. ..... 206/5; 206/38.1; 220/6

(58) Field of Classification Search ..... 206/5, 206/6, 38.1; 150/154; 220/4.21–4.28, 6–7
See application file for complete search history.

(56) References Cited

U.S. PATENT DOCUMENTS 3,601,172 A * 8/1971 Bourquin ..... 220/4.28
3,606,919 A * 9/1971 Joerger et al. ..... 220/4.23
3,814,220 A * 6/1974 Brody ..... 220/6
4,823,943 A * 4/1989 Chang ..... 206/5
5,673,788 A * 10/1997 McLane ..... 206/5
6,142,365 A * 11/2000 Breitbach ..... 220/7
2003/0010780 A1* 1/2003 Redzisz ..... 220/6
2005/0087530 A1* 4/2005 Svenson ..... 220/6

* cited by examiner

*Primary Examiner*—Bryon P. Gehman
(74) *Attorney, Agent, or Firm*—Martin Fleit; Paul D. Bianco; Fleit, Kain, Gibbons, Gutman, Bongini & Bianco, P.L.

(57) ABSTRACT

A hard case for carrying small articles, such as eyeglasses, that has a wrap-around structure composed of a plurality of panels arrayed in parallel and articulated together to be folded up by overlapping the panels. End plates are articulated to opposite ends of one of the intermediate panels. The end plates are extendible vertically and foldable down onto the panel. The hard case in one condition having the end plates extending vertically from the one panel, and the plurality of panels wrapped around the end plates to define a hard case suitable for carrying a small article. In another condition, the end plates are folded down onto the one panel with the remaining panels wrapped around the one panel to a flat configuration suitable for carrying in a person's pocket or pocketbook.

20 Claims, 10 Drawing Sheets

HARD CASE FOR CARRYING SMALL ARTICLES

BACKGROUND OF THE INVENTION

1. Field of the Invention

This invention relates to a hard case for use by a person for carrying small articles, especially eyeglasses that require protection when being transported to keep from being broken, and more particularly to such a hard case that can be folded substantially flat, after the article has been removed for use, and then conveniently stored in a pocket or pocketbook of the user. The invention also relates to the method of making the hard case.

2. Prior Art

Many proposals have been advance for collapsible boxes, knockdown boxes, foldable boxes and so forth, but none have been advanced that can be used by a person in the ordinary course of a day for carrying a small article, especially eyeglasses, that will constitute a hard case that will protect the glasses or small article, and yet, when the eyeglasses are removed, will fold up in a unique manner to become a relatively thin rectangular shape that can be easily and conveniently stored in a person's pocket or pocketbook.

SUMMARY OF THE INVENTION

It is the principal object of the present invention to provide a novel hard case that can be used by a person in the ordinary course of a day for carrying a small article, especially eyeglasses, that will constitute a hard case for protecting the glasses or small article while housed in the novel hard case, and yet, when the eyeglasses are removed, the hard case can be folded up in a unique manner into a relatively thin flat rectangular shape that can be easily and conveniently stored in a person's pocket or pocketbook. It is also a principal object of the present invention to provide a novel method for making such a hard case.

The foregoing is accomplished by a construction that utilizes a two component assembly consisting of a foldable inner box for holding the eyeglasses or article and a wrap around covering that coacts with the inner box to hold it open for reception of the eyeglasses or article, or to release the inner box to enable its fold-up and to then wrap around the folded up inner box in a unique manner to present a thin flat rectangular shape for easy and convenient storage in a person's pocket or pocketbook. In the two-component assembly of the hard case, for one embodiment of the invention, the inner box is only notionally present as will be explained hereinafter. In these circumstances, the fold up of the notional box occurs in cooperation or coaction with the wrap around covering.

The method of making the novel hard case includes the steps of making a collapsible or fold-up inner box using special hinge joints between adjacent fold-up components, and a unique jointing of the sections of the wrap around covering. A more complete understanding of the structure and method will become more evident from the following detailed description of preferred embodiments of the invention when taken with the appended drawings.

DETAILED DESCRIPTION OF PREFERRED EMBODIMENTS OF THE INVENTION

Figures 1, 2:
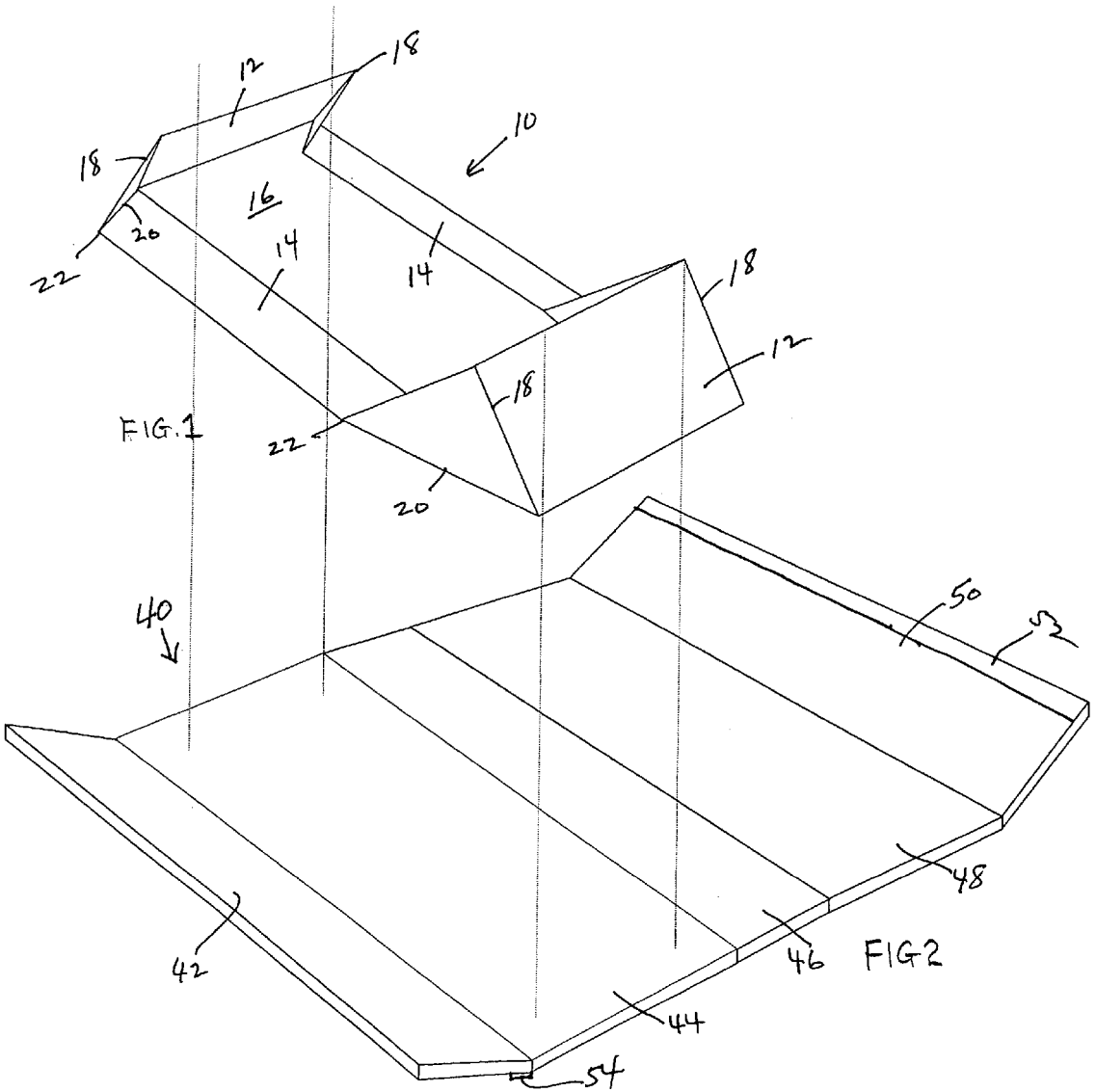
FIG. 1 is a perspective view of a first embodiment of the hard case of the invention showing the inner box with one end folded up (flat) and the other end partially open.
FIG. 2 is a perspective view of the novel wrap around covering that cooperates with the inner box of FIG. 1, showing the wrap around laid out fully.
Figure 3:
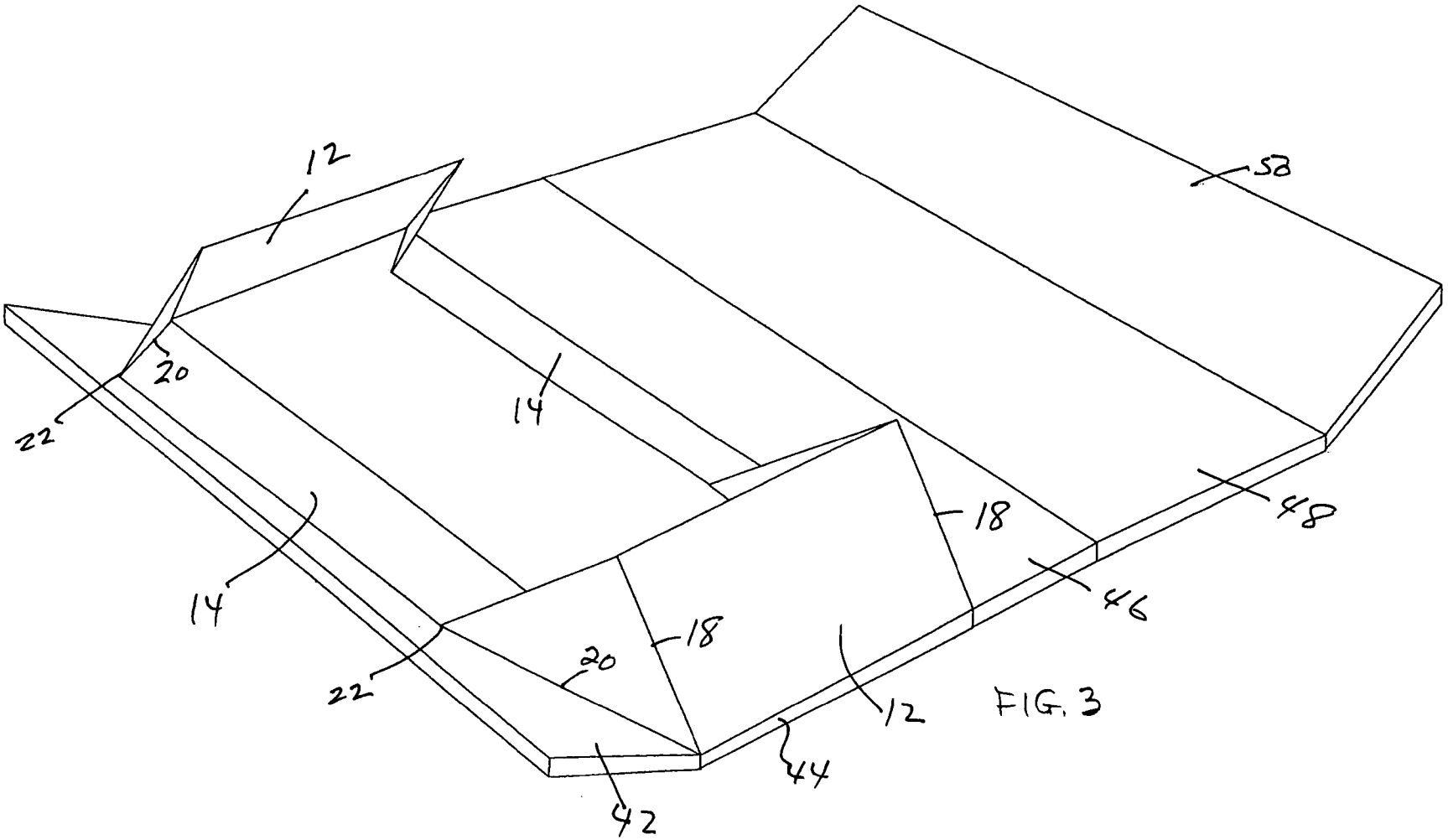
FIG. 3 is a perspective view showing the assembly of the inner box and the wrap around coupled in the manner of the invention.

The present invention relates to an innovative hard case for use by a person for carrying small articles, especially eyeglasses that require protection when being transported to keep from being broken, and more particularly to such a hard case that can be folded substantially flat, after the article has been removed for use, and then conveniently stored in a pocket or pocketbook of the user. The invention also relates to an innovative method of making a hard case.

Referring initially to the embodiment illustrated in FIGS. 1–5, the hard case of the invention consists of two essential components, namely, an inner fold-down box 10 and a wrap-around 40, that coact to provide in one condition, a hard case for carrying a small article in a protective manner, and in another condition, to enable the emptied box 10 to be folded flat and the wrap-around 40 to be wrapped around the folded flat box 10 into a compact flat geometrical configuration that allows easy storage in one's pocket or pocketbook in a non-bulky manner.

The inner fold down box 10 consists of rectangular end walls 12, rectangular side walls 14 and a bottom 16 securely fastened together by gluing or adhesives in a manner as will be described in more detail hereinafter. The wrap-around 40 consists of a series of flat parallel panels or sections, namely, a front section 42 (equal to the width of side walls 14), a bottom section 44 (equal in width to bottom 16), a back section 46 (equal in width to side walls 14), a top section 48 (equal in width to the top of the box 10) and a closure section 50. These sections are articulated one to the other in a manner as will be explained in detail hereinafter. The bottom of the box 16 is coextensive with and secured to bottom section 44. The end walls 12 and side walls 14 of box 10 extend to the same height and the box 10 is open at the top. All four corners 18, each formed at the intersection of an end wall 12 and a side wall 14, are articulated in a manner as will be explained in more detail hereinafter.

Figure 4:
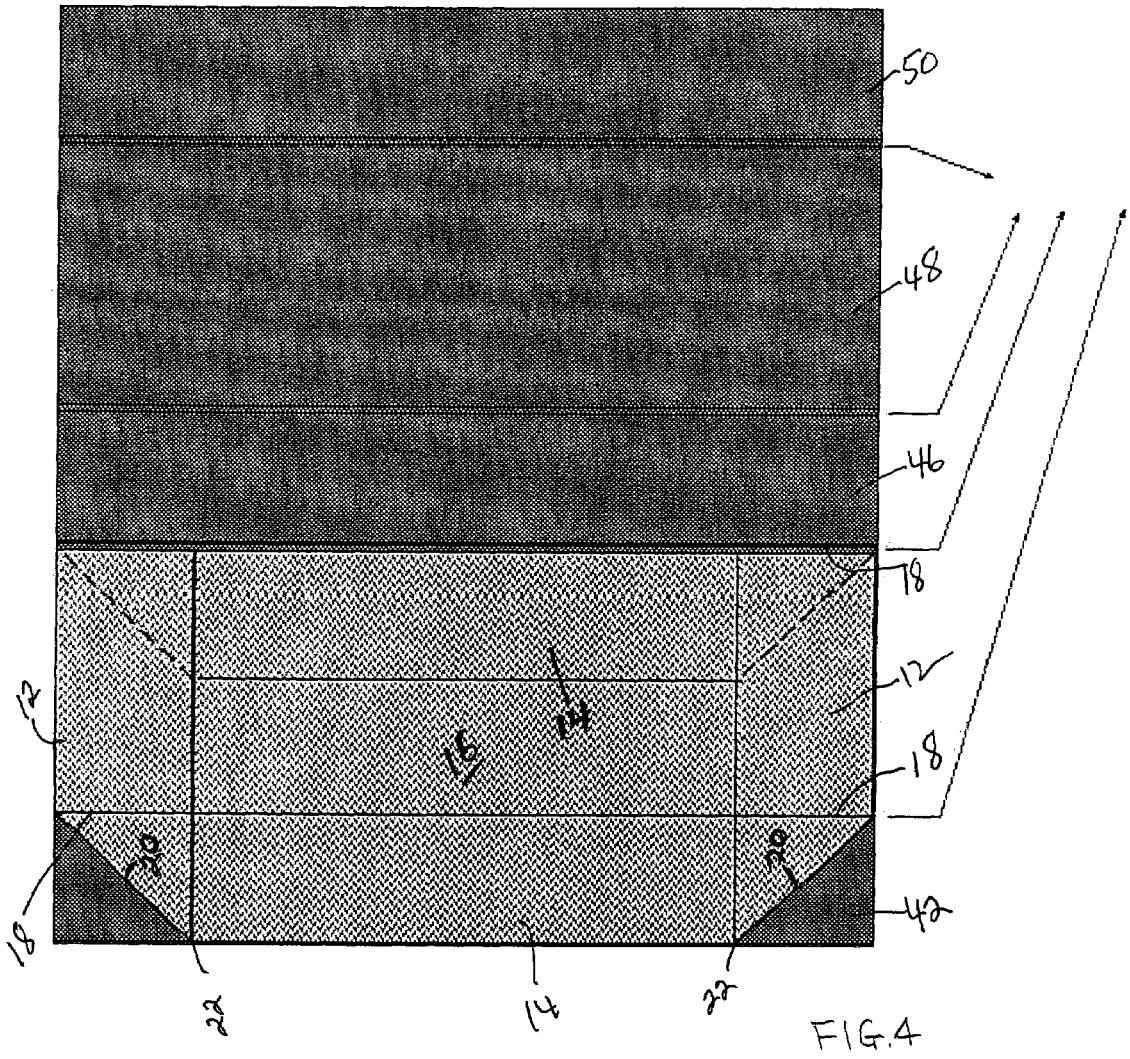
FIG. 4 is a plan view of the assembly with the inner box folded up.
Figure 5:
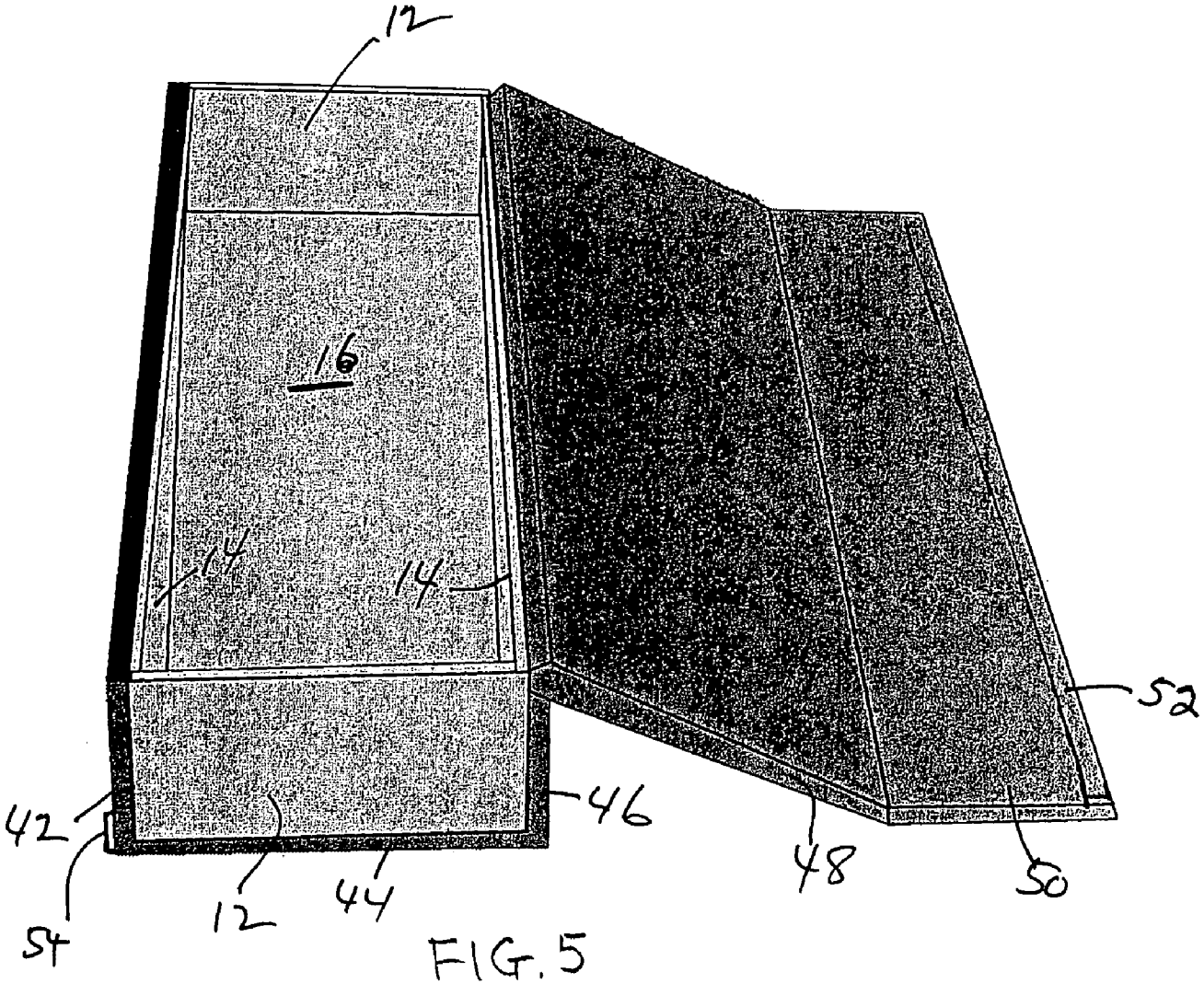
FIG. 5 is a perspective view of the assembly showing the inner box unfolded ready to receive a pair of eyeglasses, and ready for the assembly to be closed.

Also, side wall 14 on one side is provided with diagonal articulations 20 extending from the bottom of the corners 18, at approximately a 45 degree angle, to points 22 on the side wall 14, to enable the box to be folded down directly to a flat configuration as shown in FIG. 4 with corners 18 folded out to a 180 degree configuration. This side wall 14, between articulations 20, is secured to the front section 42. The opposite side wall 14 is free of the back section 46, and is provided with similar diagonal articulations 24 extending from the bottom of the corners 18, at approximately a 45 degree angle, to points 26 on side wall 14, to enable the side wall 14 of box 10 to fold inwardly and lie flat on bottom 16. In this movement, the corners 18 also fold inwardly and together so that the end walls 12 will lie flat against side wall 14 and bottom 16. This is also shown in FIG. 4. Now, the wrap-around 40 can be wrapped around the folded down box 10 with the back section 46 and the top section 48 overlying the box 10 and bottom section 44 and front section 42. Closure section 50 is now brought around to overlie the front section and be secured thereto. For example, the front section 42 and the closure section 50 can have magnetic strips 52 and 54 that register and latch together to provide an easily operable (latching and unlatching) closure for the hard case whether in open hard case condition or folded down storable condition.

Figure 9:
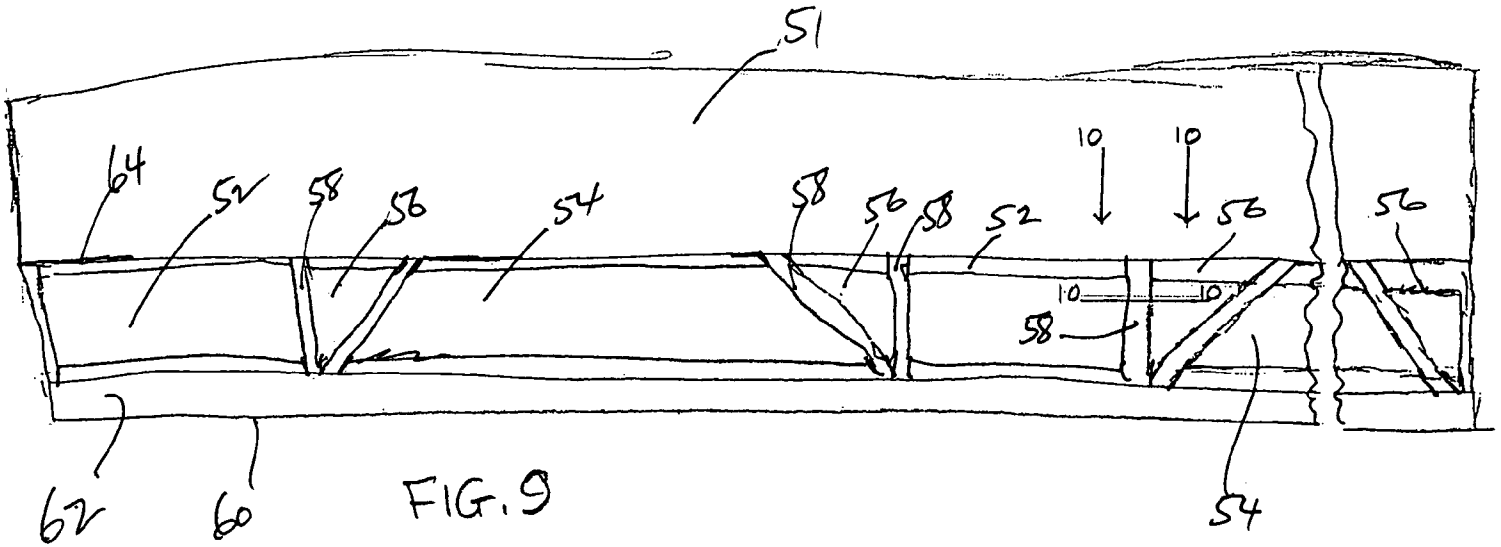
FIG. 9 is a laid-out view of the inner box of the first embodiment showing how it is assembled.
Figure 10:
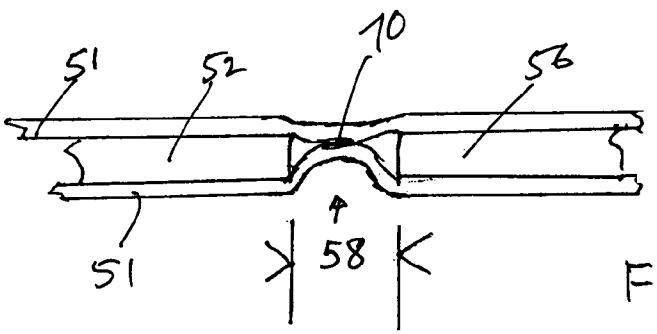
FIG. 10 is a cross sectional view of FIG. 9 taken along line 10—10 showing the manner of forming the hinges between adjacent sections of the inner box components.

Referring now to FIGS. 9 and 10, details of the construction of the box 10 and wrap-around 40 are shown. The side walls 12 and end walls 14 of the box 10 are made of cardboard pieces as shown in FIG. 9. A covering fabric 51 is laid down and cardboard pieces 52, 54 and 56 are placed on the fabric 51 in a row, as shown, separated from one another by spaces 58 equal to about twice the thickness of the cardboard. Cardboard pieces 52 are rectangular and serve for the end walls 14. Cardboard pieces 54 are trapezoidal and constitute the main portion of the side walls 12. The remaining portions of the side walls 12 are made up of triangular pieces 56 that establish the diagonal fold lines 20 and 24. The cardboard pieces are laid in alignment in a row spaced from one edge 60 of the fabric 51 by a border 62. The fabric is folded over along the fold line 64 to overlie the cardboard pieces and hold them in fixed position. A suitable glue or adhesive is used that is coated onto the fabric 51 so that when it is folded along fold line 64 it adheres to itself and the cardboard pieces, to hold everything securely in position. Further, the spaces 58, one of which is shown in detail in FIG. 10, are created by the fabric 51 being glued or adhered to itself, see 70, between the adjacent cardboard pieces. When assembled as described, the fabric-cardboard pieces form a strip that is wrapped around to bring the opposite ends together and the free ends are glued or adhered together to form the rectangular end and side walls of box 10. The border 62 is used together with bottom 16 to complete the box 10 by gluing or adhering to the bottom section 44. Finally, one of the trapezoidal side walls 14 is glued or adhered to the front section 42 as previously explained.

The fabric 51 may be any suitable material, woven, unwoven, cast, extruded or a skin, padded or multi-laminar that is flexible and sufficiently decorative so that the hard case has style and gives a pleasing appearance, and at the same time gives good protection for any small article being carried in the hard case. Although cardboard material is specified for providing the requisite stiffness for the hard case, other materials can be employed for this purpose. For example, metal or plastic pieces can be used, with or without fabric.

Also, the sections constituting the wrap-around 40 can have hinges between sections in place of or in addition to the articulations afforded by the fabric, as described. The hinges can be spring loaded to maintain the box either in condition one (formed as a hard case, or the other condition (folded flat). Also, it is possible to use detents with the hinges to hold them in one of the two conditions, by providing a flat on a hinge pin which coacts with a ball or pin, which can be spring loaded. This is a conventional and known construction.

Figure 6:
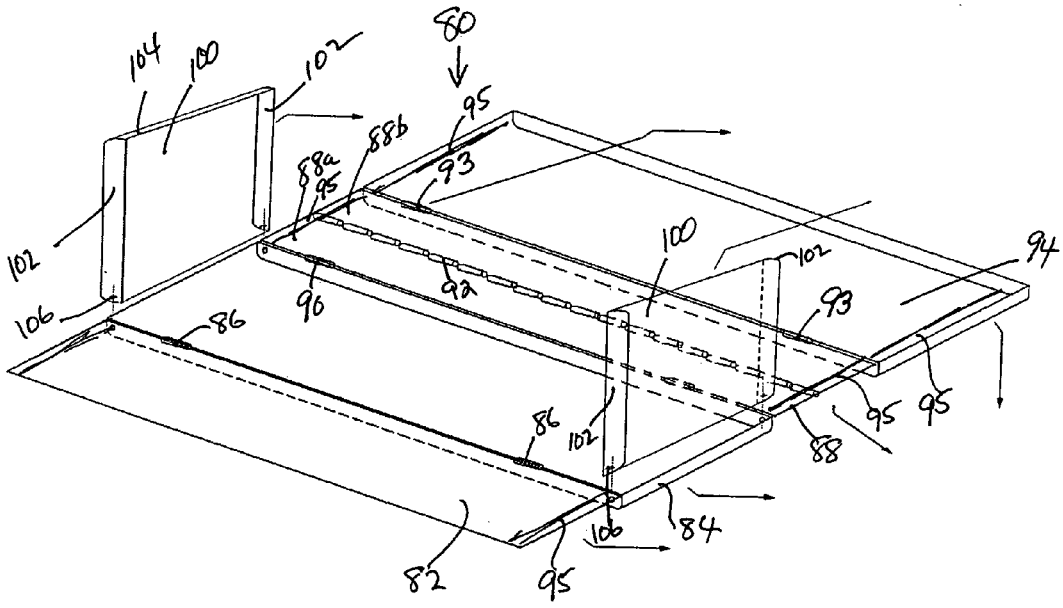
FIG. 6 is a partially exploded view of a second embodiment of the invention where the inner box is notional, and formed in part by the wrap around.
Figure 7:
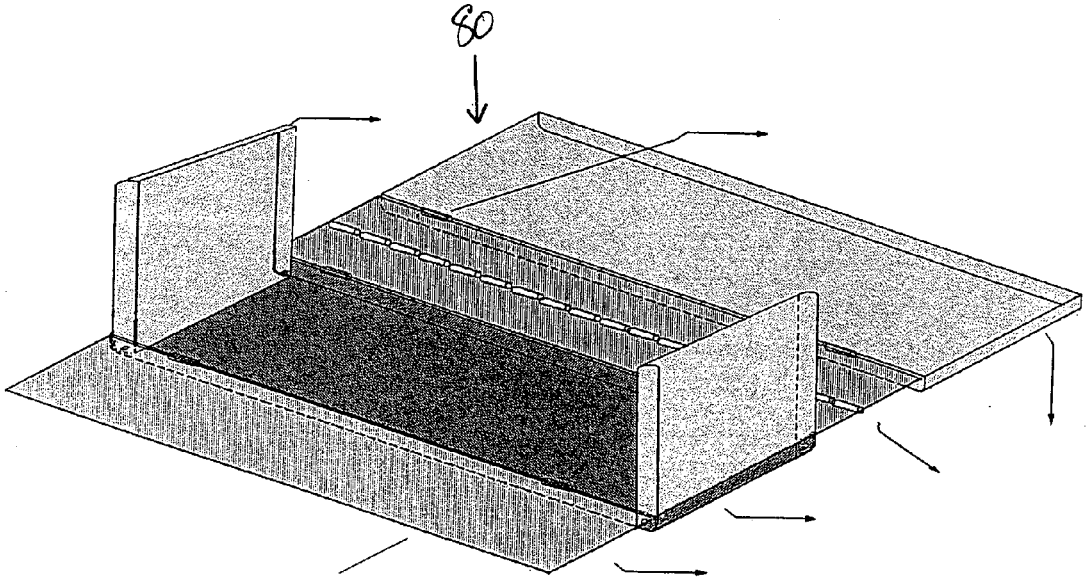
FIG. 7 is a perspective view of the second embodiment as shown in FIG. 6, ready for closure.

A second embodiment is shown in FIGS. 6 and 7, which utilizes the concept of a notional box, as opposed to a rigidly defined box like box 10 of the first embodiment. As shown in this embodiment, the wrap-around 80 consists of a front section 82, a bottom section 84 hinged to the front section 82 by hinges 86 and to a back section 88 by hinges 90. The back section 88 is divided in half into portion **88*a* and portion 88*b* which are hinged together by a so-called piano hinge 92 to enable the two portions to fold back upon themselves. Portion 88*b* is hinged by hinges 93 to top section 94. A pair of end plates 100, each having side flanges 102 and a top flange 104, are hinged or pivoted to opposite ends of bottom section 84 by pivot pins 106 in a conventional fashion. FIG. 6 is an exploded view showing the end plates 100 to be pivoted to the bottom section 84, and FIG. 7 shows the end plates positioned at opposite ends of the bottom section 84 and pivoted to the opposite ends of the bottom section 84. The hard case shown in this embodiment is closed into a hard case by pivoting the end plates 100 to their vertical position, bringing the front section 82 up to the vertical against the cooperating flanges of the end plates 100, bringing the back section 88 up to the vertical against the cooperating flanges of the end plates 100, and finally, bringing the top section 94 over the top of the box formed by end plates 100, front section 82 and rear or back section 88 to complete the closure. Top section 94 is against cooperating flanges 104 of the end plates 100. As described, magnetic adhering can be effected using magnetic strips 95 appropriately located on the front section 82 and cooperating flanges of the end plates 100, on the back section and the cooperating flanges of the end plates 100 and on the top section 94 and cooperating flanges of the end plates 100. The cooperating material with the magnetic strips 95 can be ferromagnetic material or magnetic material. Alternatively, the end plates 100** can be a ferromagnetic material, partly or wholly.

Figure 8:
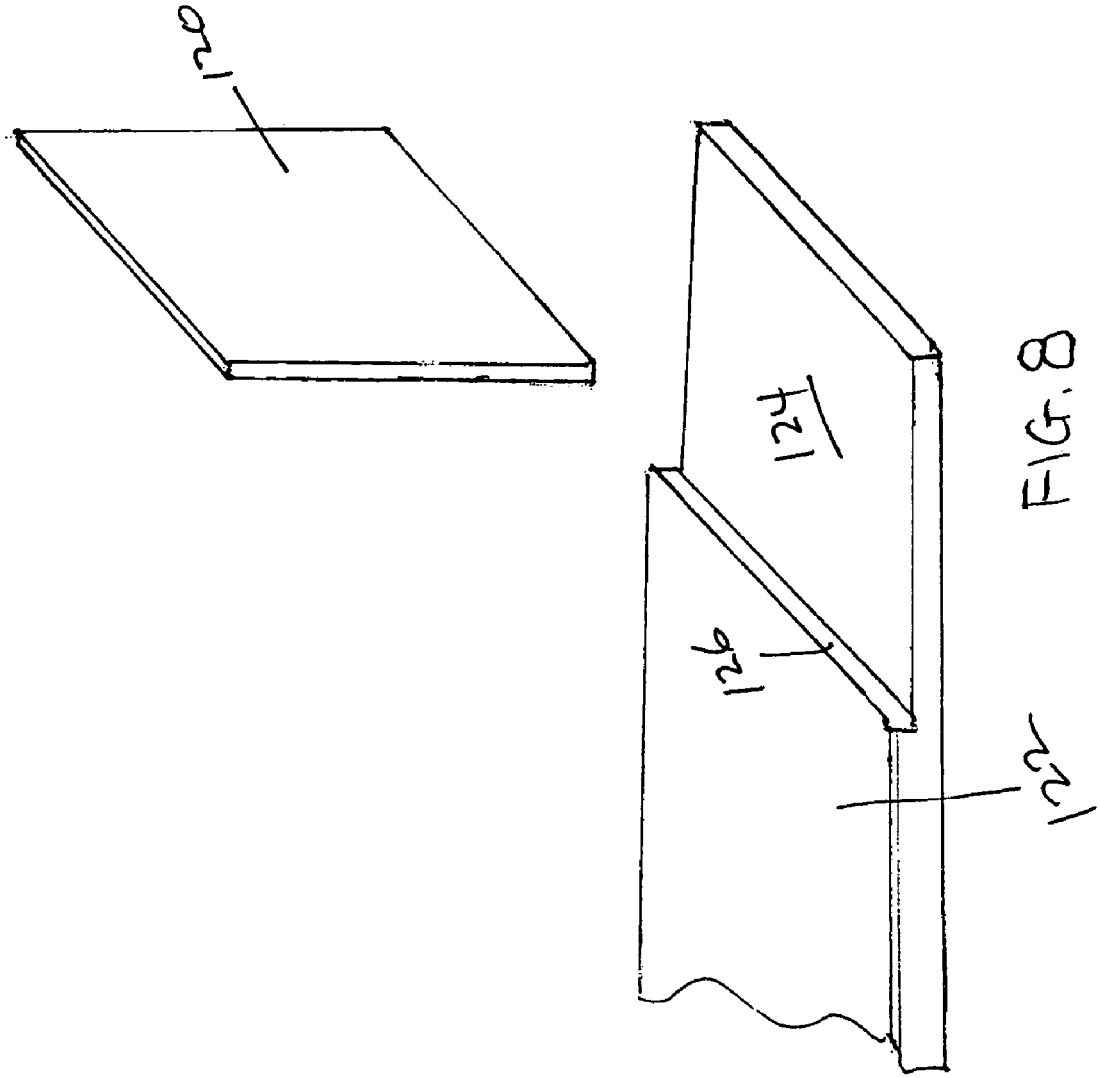
FIG. 8 is a modification of the second embodiment showing how the end plates of the notional box are fitted into the profile of the bottom of the wrap around to reduce the fold-up height of the hard case.

FIG. 8 illustrates in an exploded view an embodiment where it is desired to maintain the smallest profile. To this end, end plates 120 are hinged to the ends of the bottom section 122 (detail not shown). Terminal reduced sections 124 are provided in the end portions of bottom section 122 that terminate with shoulders 126. Section 124 is sufficiently long to accommodate the end plate 120 when it is folded down. In this manner the thickness of the folded up hard case is significantly reduced. It will be appreciated that the articulated joints heretofore described can have hinges, and may also contain springs that urge the joints to one of two predetermined conditions. Further, detents can be used as previously described. In the embodiment of FIGS. 6 and 7, hinges are used and the sections of the wrap-around 80 are hinged together as shown.

Figure 11:
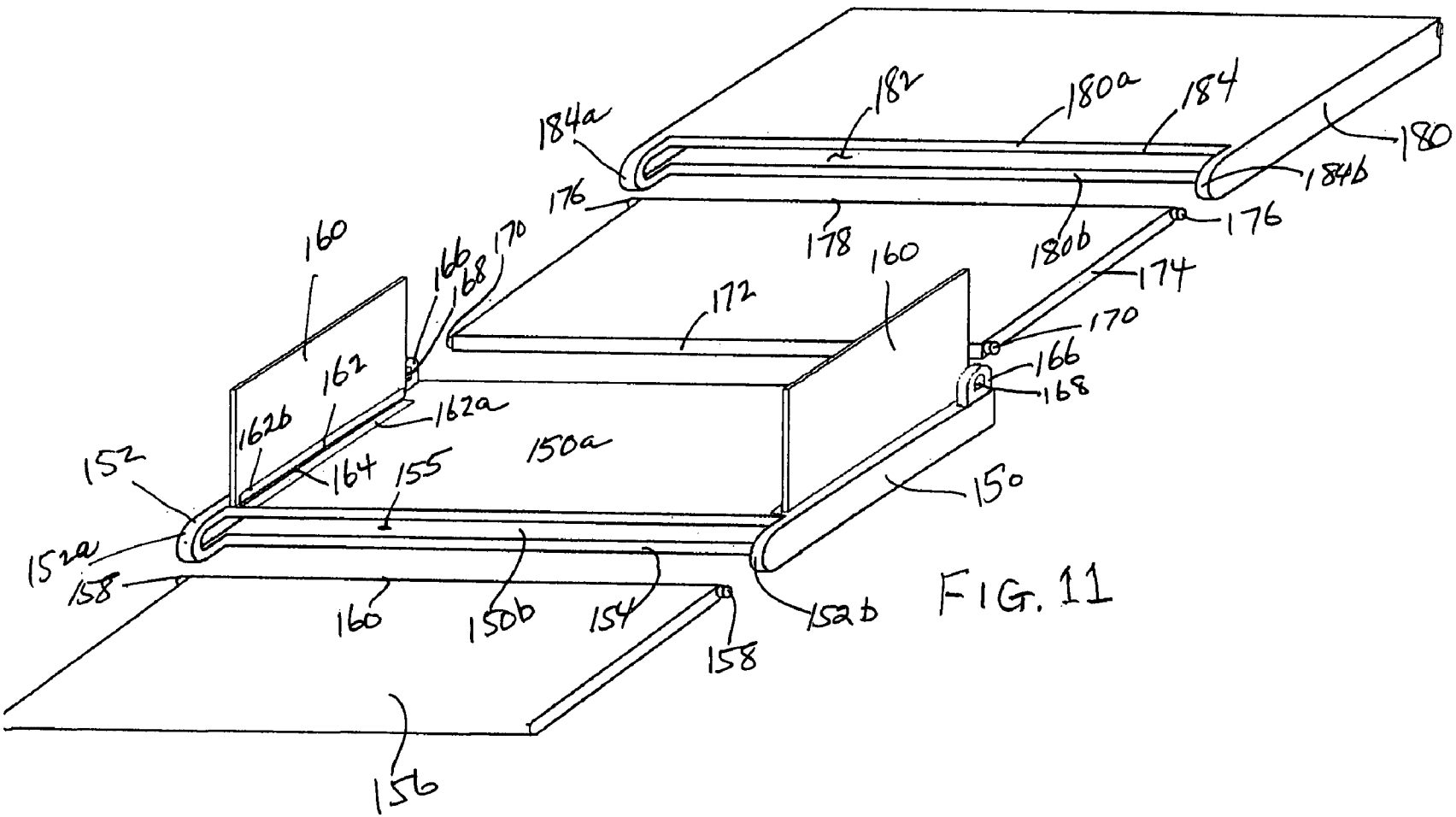
FIG. 11 is an exploded view of another embodiment of the present invention.
Figure 12:
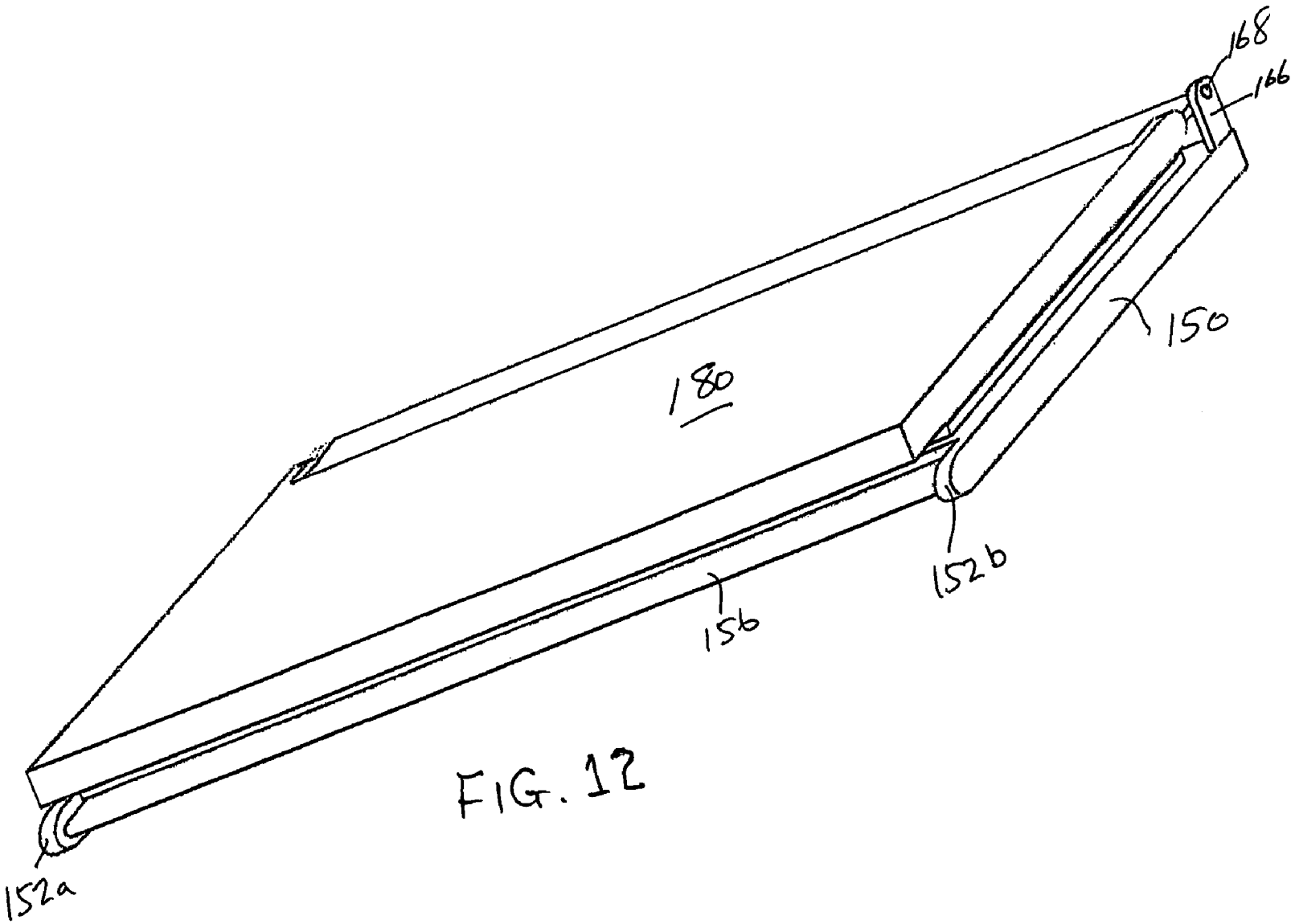
FIG. 12 is a perspective view of the embodiment shown in FIG. 11.

FIGS. 11 and 12 illustrate still another embodiment of the present invention. In this embodiment, the components are preferably composed of thin metal or plastic plates. FIG. 11 is a partially exploded view showing a bottom section 150 that consists of a plate folded on itself at folds 152 to form overlying portions 150*a* and 150*b* with a space 155 defined between them to accommodate front section 156. Much of the fold is cutout at 154 leaving only terminal folds 152*a* and 152*b*, and allowing front plate or section 156 to slide between them into the space afforded between them. A pair of pins 158 project from the front edge 160 of the front plate 156, that are trapped within the space between portions 150*a* and 150*b* by being received within the folds 152*a* and 152*b* when front plate 156 is pulled fully out of the space 155. End plates 160 are mounted on the top portion 150*a* at opposite ends thereof. An L shaped bracket 162 has it horizontal leg 162*a* attached or fixed to the portion 152*a* spaced inward of the edge, and its vertical leg 162*b* fixed or attached to plate 160. The two legs 162*a* and 162*b* are interconnected by a hinge 164 to enable the plate 160 to fold down onto portion 150*a*.

At the edge of the portion 150*a* opposite the folds 152*a* and 152*b* are posts 166 defining openings 168 for receiving pivot pins 170 projecting away from the leading edge 172 of back section or plate 174. The spacing of the posts 166 is such to enable the plate 174 to pivot down onto bottom section or plate 150*a*. To this end, the end plates 160 do not extend coextensive with plate 150*a* but terminate to leave posts 166 free. Similar pivot pins 176 project away from the trailing edge 178 of plate 174. The front plate 156, the rear or back plate 174 extend the same height as the end plates 160 to notionally define the box in which the article is to be carried. Plate 174 is fit into, in sliding relationship, a top plate or section 180 that is made similarly to bottom plate 150. That is, plate 180 is folded on itself with a space 182 defined between the top portion 180*a* and the bottom portion 180*b*, and with the fold cutout at 184 leaving terminal folds 184*a* and 184*b* to cooperate with the pivot pins 176, enabling the plate 180 to pivot with respect to back plate 174.

To put the assembly into the first condition where the hard case is constituted, the end plates 160 are put in their vertical position relative to the bottom plate or section 150*a*, front plate 156 is pivoted up to the vertical and held against the edges of the end plates 160 by any suitable means, such as magnetic, rear or back plate 174 is pivoted to its vertical position against the edges of end plates 160 and held against the edges of the end plates by any suitable means, such as magnetic, and the top cover or plate 180 is pivoted to close the formed box by being brought against the edges of end plates 160 and the top edges of plates 156 and 174, and held by any suitable means such as magnetic.

To go from the first condition to the folded up condition, the top plate 180 is pivoted to the horizontal, the rear plate 174 is pivoted to the horizontal and slid into the top plate 180, front plate 156 is pivoted to the horizontal and slid into the bottom plate 150. Next, the end plates 160 are pivoted downwardly onto bottom plate 150, and finally, top plate 180 is pivoted to overlie the bottom plate 150. The folded up case is now as shown in FIG. 12.

Although the invention has been described in terms of specific embodiments, nevertheless changes and modifications are possible which do not depart from the teachings herein and such changes and modifications will be evident to those skilled in the art from a knowledge of the specific embodiments disclosed herein. Such changes and modifications are deemed to fall within the purview of the invention as claimed.

What is claimed is:

1. A hard case for carrying a small article comprising:

a plurality of elongated hard panels arrayed in a flat parallel side-by-side transverse arrangement and articulated together in a spaced manner to enable the panels to be folded up into a rectangular shape with end panels of the plurality of panels overlapped;

an inner rectangular open top box including a bottom portion and side and end wall portions, the bottom portion of said open top box being fixed to one of the plurality of panels next adjacent to an end panel, one wall portion of the open top box being fixed to said next adjacent end panel;

said open top box being foldable down horizontally to a flat configuration, and being foldable up vertically to an open top box configuration;

the hard case in a first condition, when carrying a small article, having the open top box folded up vertically to its open box configuration with the panels folded around the box and the two end panels overlapped, and in a second condition, when not carrying a small article, the open box is folded down horizontally to its flat configuration with the panels wrapped around the flat box to form a flat, compact structure, configured and dimensioned to be carried in a person's pocket or pocketbook.

2. A hard case according to claim 1 wherein the panels are made of cardboard coveted with one of fabric, plastic and leather.

3. A hard case according to claim 1 wherein the panels are composed of thin sheets of one of metal and plastic.

4. A hard case according to claim 1 wherein the panels have cushioning.

5. A hard case according to claim 1 wherein a latch is provided for closing the hard case when in the first condition.

6. A hard case according to claim 1 wherein latching is provided for closing the hard case in the first and second conditions.

7. A hard case according to claim 1 wherein a magnetic strip is provided to maintain closure of the hard case in the first condition.

8. A hard case according to claim 1 wherein the panels are made of cardboard pieces spaced apart about twice the thickness of the cardboard.

9. A hard case according to claim 1 wherein in the second condition the side walls fold down horizontally flat, such that the one side wall folds out of the inner box onto the attached end panel and an opposite side wall folds into the inner box onto the bottom of the inner box.

10. A hard case according to claim 1 wherein at least one of the plurality of panels is configured with a slot to receive an adjacent panel therein in sliding relationship.

11. A hard case according to claim 1 wherein a panel adjacent to said one panel is divided in half by a hinge to enable the panel adjacent to fold back upon itself.

12. A hard case according to claim 1 wherein the end wall portions are flanged to contact at least one of the plurality of panels.

13. A hard eyeglass case comprising:

a wrap-around structure including front, bottom, back, and top panels, the front panel articulated to the bottom panel, the bottom panel articulated to the back panel, and the back panel articulated to the top panel; and an inner box structure including a bottom portion secured to the bottom panel and a pair of end walls extending from opposite ends of the bottom portion, the end walls having a vertical position in which the end walls extend substantially perpendicularly to the bottom portion to define a space therebetween and a horizontal position in which the end walls extend substantially parallel to the bottom portion, wherein the hard case has a first configuration in which the end walls are in the vertical position and the front, bottom, back, and top panels wrap around the inner box to enclose an article located in the space and the hard case has a second configuration in which the end walls are in the horizontal position and the front, bottom, back, and top panels wrap around the inner box such that the hard case has a flat configuration configured and dimensioned for carrying in a person's pocket or pocketbook.

14. A hard case according to claim 13 wherein the inner box structure further comprises a pair of side walls extending from opposite sides of the bottom portion and interposed between the pair of end walls, wherein the pair of side walls extend substantially perpendicularly to the bottom portion when the ends walls are in the vertical position and the pair of side walls fold down substantially parallel to the bottom portion when the end walls are in the horizontal position.

15. A hard case according to claim 14 wherein one of the side walls folds down onto the front panel.

16. A hard case according to claim 15 wherein the one side walls is secured to the front panel.

17. A hard case according to claim 15 wherein the panels are made of cardboard covered with one of fabric, plastic and leather.

18. A hard case according to claim 15 wherein the panels are composed of thin sheets of one of metal and plastic.

19. A hard case according to claim 15 wherein a latch is provided for closing the hard case when in the first configuration.

20. A hard case according to claim 15 wherein the panels are made of cardboard pieces spaced apart about twice the thickness of the cardboard.

* * * * *